United States Patent [19]

Winn

[11] 4,021,764

[45] May 3, 1977

[54] SHEET-WOUND TRANSFORMER COILS WITH REDUCED EDGE HEATING

[75] Inventor: Oliver H. Winn, Marlton, N.J.

[73] Assignee: General Electric Company, Schenectady, N.Y.

[22] Filed: Dec. 8, 1975

[21] Appl. No.: 638,612

[52] U.S. Cl. ..... 336/84; 336/212; 336/223

[51] Int. Cl.[2] ..... H01F 15/04

[58] Field of Search ..... 336/83, 84, 223, 232, 336/212, 214, 215, 233, 197, 60, 221

[56] References Cited

UNITED STATES PATENTS

| | | | |
|---|---|---|---|
| 1,335,837 | 4/1920 | Jacobson | 336/84 X |
| 2,850,707 | 9/1958 | Wroblewski et al. | 336/83 |
| 2,907,965 | 10/1959 | Mercier | 336/84 |
| 2,962,679 | 11/1960 | Stratton | 336/221 X |
| 3,014,189 | 12/1961 | MacKinnon et al. | 336/83 X |
| 3,366,907 | 1/1968 | Tipton | 336/197 |
| 3,609,613 | 9/1971 | Horn et al. | 336/83 |
| 3,663,910 | 5/1972 | Grubb | 336/60 |
| 3,750,070 | 7/1973 | Rissinger | 336/84 |

FOREIGN PATENTS OR APPLICATIONS

| | | | |
|---|---|---|---|
| 1,557,420 | 2/1969 | France | 336/212 |
| 1,030,842 | 5/1966 | United Kingdom | 336/197 |
| 827,506 | 2/1960 | United Kingdom | 336/223 |

*Primary Examiner*—Thomas J. Kozma
*Attorney, Agent, or Firm*—Marvin Snyder; Joseph T. Cohen; Jerome C. Squillaro

[57] ABSTRACT

In sheet-wound transformer coils, excessive ohmic losses due to high current density at the sheet edges caused by a radial magnetic leakage field are avoided by adding ferrite ceramic disks, or disks and strips, adjacent each axial end of the coils, to lead magnetic leakage flux axially out of the sheet metal windings.

11 Claims, 3 Drawing Figures

SHEET-WOUND TRANSFORMER COILS WITH REDUCED EDGE HEATING

This invention relates to transformers, and more particularly to sheet-wound transformer coils exhibiting reduced ohmic losses especially in high voltage applications.

W. F. Westendorp application Ser. No. 638,613 filed concurrently herewith and assigned to the instant assignee, points out that in a transformer comprised of sheet-wound coils of the type described and claimed in S. F. Philp application Ser. No. 618,459 filed Oct. 1, 1975 and assigned to the instant assignee, the magnetic leakage field is strongest between the low and high voltage windings. The axial component of the magnetic leakage field diminishes, from this maximum value, nearly linearly with radial distance into either winding, to approximately zero on the inside of the inner winding or outside of the outer winding. The strongest component of the leakage field is the axial component, and thickness of the sheet metal employed in the coils may be chosen sufficiently small to result in low eddy current loss caused by the axial component of the leakage field in the sheet conductor despite its high conductivity, requiring use of a double sheet on either side of thin insulation, in some instances, in order to carry the maximum rated load current.

The aforementioned Westendorp application states that above and below the median plane (or plane of symmetry normal to the axis of the coils) the leakage field exhibits radial components which cause a maldistribution of current in the sheet-metal windings; that is, current density is highest at the sheet winding edges, resulting in greater ohmic losses in the windings than if current density were uniform throughout the sheet. Since both the radial thickness and axial dimension of the sheet-wound high voltage coil are very large compared to the skin depth at 60 Hertz (or depth below the surface at which current density is one neper below the surface current density), the leakage field radial component $B_y$ is essentially zero within the winding and is confined to the region near the axial ends of the winding where its magnitude varies as an exponential function of axial distance Z from the nearest axial end according to $$B_y = B_o \exp(-Z/\delta)$$

where $B_o$ is the leakage field maximum radial flux density component and $\delta$ is the skin depth.

In large, sheet-wound transformers, increased current density at the coil edges, due to radial leakage flux, can cause excessive heating. As pointed out in the Westendorp application, this current density adds to the normal load current density in the sheet windings and varies with distance from the nearest axial end of the coil according to the same exponential function as the radial leakage flux density. It is desirable to reduce this excessive heating and thus obviate the complexity and cost of accommodating such heating in the transformer.

The Westendorp application teaches use of apparatus adjacent the sheet edges to lead the leakage flux out of the sheet-wound coils in an axial direction, rather than a radial direction. This reduces excessive heating at the coil edges. Under high voltage conditions, however, use of magnetic steel or other low reluctance material of high electrical conductivity may necessitate a more complex transformer design in order for the transformer to be capable of withstanding these voltages. It would be advantageous, therefore, to simplify the design of sheet-wound transformers, especially those intended for high voltage applications.

Accordingly, one object of the invention is to prevent excessive heating at the edges of sheet-wound transformer coils used in high voltage applications.

Another object is to provide simplified apparatus for limiting edge current density in a sheet-wound transformer coil to a value comparable to the load current density.

Another object is to provide a low reluctance path, exhibiting high electrical resistivity, for magnetic leakage flux from sheet-wound transformer coils.

Briefly, in accordance with a preferred embodiment of the invention, an electrical transformer comprises a conducting sheet overlaid by insulation, and a magnetic core. The conductive sheet is wound continuously in a plurality of turns about the core. A ceramic disk is situated closely adjacent at least one axial edge of the wound turns for carrying a large radial component of the magnetic flux leakage field established by current flow through the conductive sheet.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
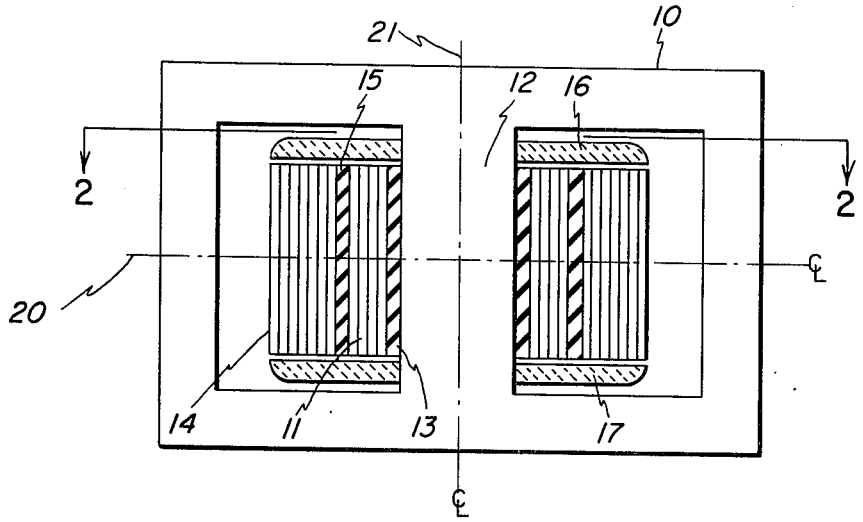
FIG. 1 is a cross sectional side view of a single phase sheet-wound transformer constructed in accordance with the teachings of the instant invention.

FIG. 1 illustrates a sheet-wound transformer comprising a laminated core 10 having a low voltage winding 11 wound about an insulating, inner cylinder 13 encircling center leg 12 of the core. A high voltage winding 14 is wound about insulation means 15 which separates the high and low voltage windings and acts as a reactance gap in the transformer. In both windings, each turn is insulated from the adjacent turn, preferably by polymer film insulation (not shown).

Figure 2A:
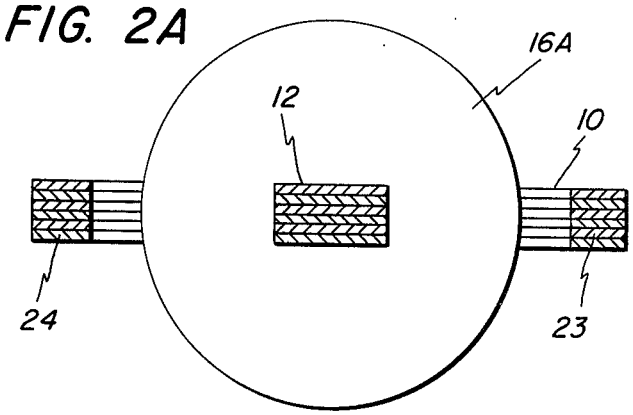
FIG. 2A is a sectional view taken along line 2—2 of FIG. 1 illustrative of one embodiment of the invention.

Situated adjacent each axial end of coils 11 and 12 are ceramic disks or plates 16 and 17, respectively, which may extend completely out over the inner and outer sheet-wound coils, such as disk 16A shown in FIG. 2A which corresponds to disk 16 of FIG. 1. The disks, because of their high electrical resistivity, may abut the edges of windings 11 and 14 without significant danger of short-circuiting the windings, which is especially advantageous where the windings carry high voltages. In an alternative configuration, disks 16 and 17 may extend completely out over the inner sheet-wound coil, such as disk 16B shown in FIG. 2B which corresponds to disk 16 of FIG. 1, with a pair of extensions 18 and 19 of disk 16B extending out to the outermost turn of outer coil 14. Extensions 18 and 19 are located only in the vicinity of the outermost legs of core 10, where the magnetic leakage field is relatively strong, and are aligned between each of the core outer legs 23 and 24, respectively, and core center leg 12. In each instance, the core outer legs, which are radially outside windings 11 and 14, are integrally joined to the center leg axially outside of the ceramic disks.

Figure 2B:
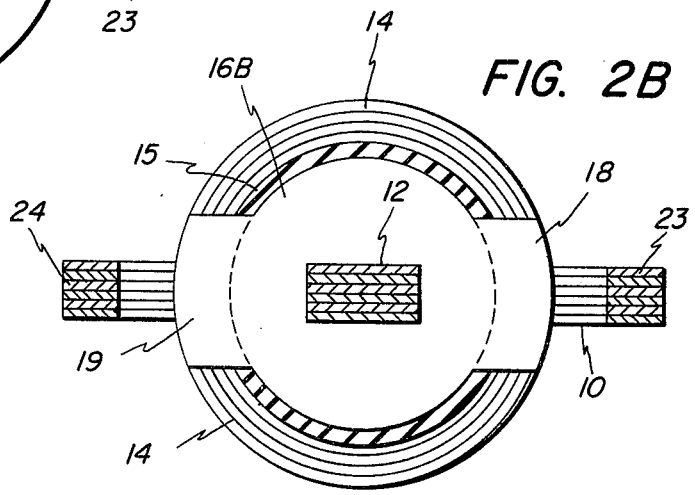
FIG. 2B is a sectional view along line 2—2 of FIG. 1 illustrative of another embodiment of the invention.

Although extensions 18 and 19 of disk 16B are illustrated in FIG. 2B as integral with the disk, those skilled in the art will appreciate that regions 18 and 19 may comprise ceramic strips separate from the disk. Ceramic disks 16 and 17, as well as ceramic regions 18 and 19, may be maintained in contact with windings 11 and 14 by, for example, strap means (not shown) extending axially about the windings and around the ceramic components so as to hold the ceramic components against the windings.

Although there may be a plurality of ceramic materials that are usable in disks 16 and 17, and in strips 18 and 19 if not integral with a disk, a typical material for use therein, in power transformer applications, is a manganese zinc ferrite such as that denominated 3C8 and available from Ferroxcube Corporation, Saugerties, New York. In the alternative, a ferrite selected from the 8000 series sold by Indiana General Electronic Products, Keasbey, New Jersey, may be employed.

During transformer operation, current passing through the sheet windings sets up a field of magnetic leakage flux which, in the region of the windings, is of greatest intensity in the axial direction in the reactance gap between the high and low voltage windings. At the median plane 20, which is the plane of symmetry perpendicular to transformer axis 21 shown in FIG. 1, the leakage field essentially has no radial components. As axial distance from median plane 20 increases so as to approach either axial end of coils 11 and 14, the leakage field manifests increasingly stronger radial components which reach their maxima in disks 16 and 17, rather than at the ends of the coils. Thus while current density at the coil edges, induced by the radial component of the leakage field, adds to the normal load current density, the added component is of such small magnitude that ohmic losses are not greatly increased at the coil edges. Generation of excessive heat at the coil edges is thus avoided. Moreover, the ceramic material itself does not experience an excessive rise in temperature, due to its high resistivity. This is because ohmic heat losses in the material vary inversely with resistivity for any given value of induced voltage therein. In this fashion, therefore, ohmic losses in the transformer are minimized, permitting greater operating efficiency.

The foregoing describes improved sheet-wound transformer coils, capable of use in high voltage applications, in which excessive heating at the coil edges is prevented. Simplified apparatus is employed for limiting edge current density in a sheet-wound transformer coil to a value comparable to the load current density. A low reluctance path exhibiting high electrical resistivity is provided for magnetic leakage flux from sheet-wound transformer coils.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. An electrical transformer comprising:

at least one conductive sheet overlaid by insulation;

a magnetic core, said conductive sheet being wound continuously in a plurality of turns about a first leg of said core; and a magnetic disk situated closely adjacent at least one axial edge of said turns for carrying a large radial component of the magnetic flux leakage field established by current flow through said conductive sheet, said core comprising a second leg radially outside the wound conductive sheet and being integrally joined to said first leg axially outside of said ceramic disk.

2. The electrical transformer of claim 1 wherein said ceramic disk is of annular configuration generally coextensive with the cross sectional area of said turns.

3. The electrical transformer of claim 1 wherein said ceramic disk is comprised of a manganese zinc ferrite.

4. The electrical transformer of claim 2 wherein said ceramic disk is comprised of a manganese zinc ferrite.

5. An electrical transformer comprising:

a core of magnetic material;

a first coil wound about a first leg of said core, said first coil being formed from a first conductive sheet overlaid by insulation;

a second coil wound about said first coil, said second coil including a second conductive sheet overlaid by insulation; and a magnetic ceramic disk situated closely adjacent at least one axial edge of each of said first and second coils for carrying a large radial component of the magnetic flux leakage field established by current flow through said conductive sheet, said core comprising a second leg radially outside the wound conductive sheets and being integrally joined to said first leg axially outside of said ceramic disk.

6. The electrical transformer of claim 5 wherein said ceramic disk is comprised of a manganese zinc ferrite.

7. The electrical transformer of claim 5 wherein said ceramic disk is of annular configuration generally coextensive with the combined cross sectional area of said first and second coils.

8. The electrical transformer of claim 5 wherein said ceramic disk is of annular configuration generally coextensive with the cross sectional area of said first coil, said transformer further including first and second ceramic strips situated adjacent the perimeter of said ceramic disk, each of said first and second ceramic strips being substantially coextensive with a first and second portion, respectively, of said second coil.

9. The electrical transformer of claim 8 wherein said first and second ceramic strips are integral with said ceramic disk.

10. The electrical transformer of claim 8 wherein said core of magnetic material includes a center leg and two outer legs, said first coil being wound about said center leg and said first and second ceramic strips being aligned between each of said outer legs, respectively, and said center leg.

11. The electrical transformer of claim 10 wherein said first and second ceramic strips are integral with said ceramic disk.

* * * * *